US006066208A

United States Patent [19]

Knop et al.

[11] Patent Number: 6,066,208

[45] Date of Patent: May 23, 2000

[54] APPARATUS FOR COATING A CONTINUOUSLY MOVING WEB

[75] Inventors: Reinhard Knop, Essen; Gerhard Wohlfeil, Monheim; Ingo Becker, Köln, all of Germany

[73] Assignee: Jagenberg Papiertechnik GmbH, Neuss, Germany

[21] Appl. No.: 08/794,734

[22] Filed: Feb. 3, 1997

[30] Foreign Application Priority Data

Feb. 3, 1996 [DE] Germany ..... 196 03 861

[51] Int. Cl.[7] ..... B05C 3/02

[52] U.S. Cl. ..... 118/413; 118/681; 118/258

[58] Field of Search ..... 118/413, 680, 118/681, 263, 258, 249, 414; 101/216, 247

[56] References Cited

U.S. PATENT DOCUMENTS

| | | | |
|---|---|---|---|
| 3,070,461 | 12/1962 | Beachler . | |
| 3,079,889 | 3/1963 | Jacobs . | |
| 3,418,970 | 12/1968 | Phelps et al. . | |
| 3,688,735 | 9/1972 | Brenner | 118/681 |
| 4,440,809 | 4/1984 | Vreeland | 118/410 |
| 4,675,230 | 6/1987 | Innes . | |
| 5,368,893 | 11/1994 | Sommer . | |
| 5,460,119 | 10/1995 | Maroszek . | |

FOREIGN PATENT DOCUMENTS

| | | |
|---|---|---|
| 0 109 520 | 5/1984 | European Pat. Off. . |
| 0 051 698 | 8/1986 | European Pat. Off. . |
| 30 22 955 | 12/1981 | Germany . |
| 36 23 402 | 5/1987 | Germany . |
| 41 30 118 | 3/1993 | Germany . |
| 3 772 00 | 4/1994 | Switzerland . |
| 994 191 | 6/1965 | United Kingdom . |

*Primary Examiner*—Brenda A. Lamb
*Attorney, Agent, or Firm*—Herbert Dubno; Andrew Wilford

[57] ABSTRACT

An apparatus for applying a coating liquid to a web moving continuously along a path has a main frame forming an open space and a main backing roller journaled on the main frame and around which the web passes. A second frame in the space is independent of the main frame and displaceable relative thereto from a position in the space juxtaposed with the backing roller. An applicator unit on the second frame applies an excess of the coating liquid to the web and a dosing unit downstream along the path from the applicator unit strips from the web excess coating liquid and leaves on the web a coating of the liquid of a predetermined thickness.

14 Claims, 5 Drawing Sheets

APPARATUS FOR COATING A CONTINUOUSLY MOVING WEB

FIELD OF THE INVENTION

The present invention relates to an apparatus for coating a web. More particularly this invention concerns such an apparatus which applies a thin coat of a liquid to a web several meters wide as the web moves continuously through the apparatus.

BACKGROUND OF THE INVENTION

In order to apply a coating liquid such as ink, paint, or varnish to a web of paper or cardboard in a large production operation it is standard to pass the moving web around a large-diameter backing roller that is juxtaposed with an applicator unit that coats the web with a thick layer of the liquid and, downstream therefrom, a dosing unit that removes excess liquid, leaving on the web a coating or film of the desired thickness. The applicator can be a roller (German 3,623,402 of H. Sommer) or tray (European 0.051, 698 of W. Damrau). The dosing system can be a mechanical blade (German 3,623,402 of H. Sommer cited above), a rod (German 3,022,955), a scraper (European 0,109,520 of H. Sommer), or a so-called air knife (U.S. Pat. No. 5,368,893 of H. Sommer). In order to maximize production speed it is known to arrange the applicator and dosing units around backing rollers at which the web is supported over its entire width (U.S. Pat. No. 5,460,119 of H. Maroszek).

In the production of a coated paper or cardboard web the applicator and dosing units must be right for the particular type of paper and the type of coating liquid. In particular at high web speeds of 1000 m/min these units must work perfectly and correspond exactly to the requirements of the current run. As a result it is standard in the prior-art systems to have considerable down time while the applicator and dosing units are reset and/or replaced between runs.

OBJECTS OF THE INVENTION

It is therefore an object of the present invention to provide an improved apparatus for coating a continuously moving web.

Another object is the provision of such an improved apparatus for coating a continuously moving web which overcomes the above-given disadvantages, that is which can be switched over relatively quickly between succeeding production runs.

SUMMARY OF THE INVENTION

An apparatus for applying a coating liquid to a web moving continuously along a path has according to the invention a main frame forming an open space and a main backing roller journaled on the main frame and around which the web passes. A second frame in the space is independent of the main frame and displaceable relative thereto from a position in the space juxtaposed with the backing roller. An applicator unit on the second frame applies an excess of the coating liquid to the web and a dosing unit downstream along the path from the applicator unit strips from the web excess coating liquid and leaves on the web a coating of the liquid of a predetermined thickness.

Thus with this system it is possible to pull out and service or replace the applicator with ease. The down time between changeover from one web and/or coating liquid to another can be reduced to a bare minimum.

According to the invention the main frame forms an opening into the space and the second frame is movable horizontally out of the space through the opening. The opening can open against a direction of movement of the web or transversely to a direction of movement of the web.

In accordance with a further feature of the invention a second backing roller is journaled on the second frame and juxtaposed with the applicator unit. This forms a straight stretch in the web and the applicator and dosing units are juxtaposed with the web at upstream and downstream end regions of this straight stretch.

The coating apparatus can further have according to the invention a third frame independent of the main frame, carrying the dosing unit, and displaceable relative to the main frame from a position juxtaposed with the backing roller.

The applicator unit normally includes an applicator roller but can instead have a tray holding the liquid and juxtaposed with the backing roller. Alternately it includes a slot nozzle open toward the web.

The dosing unit can be mounted on the main, second, or third frames.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
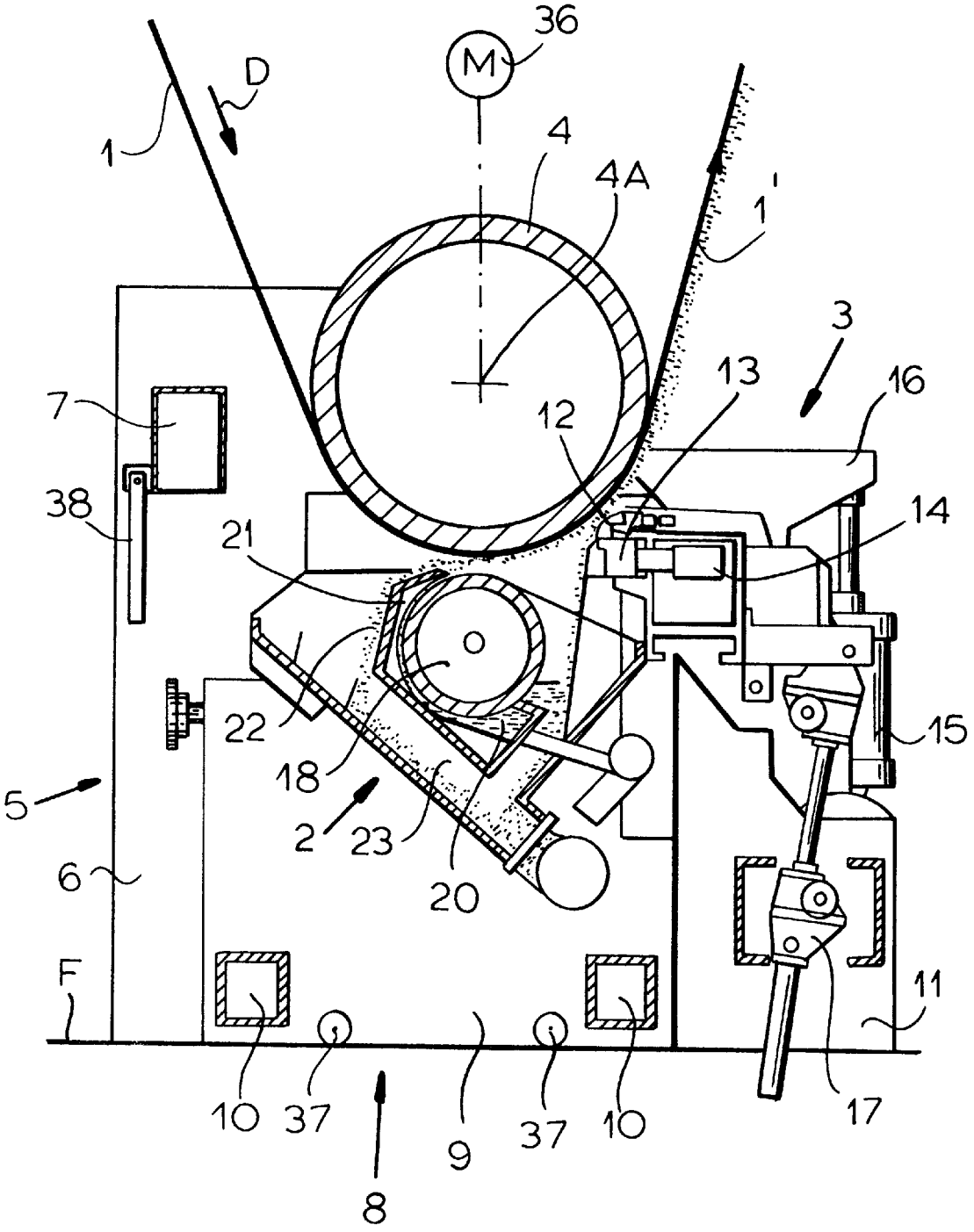
FIG. 1 is a partly schematic vertical section through the apparatus according to the invention.

As seen in FIG. 1 a paper web 1 several meters wide is provided with a coating 1' of a treatment liquid, here paint, by an applicator unit 2 with the thickness of the coating 1' adjusted by a dosing unit 3 downstream in a travel direction D of the web 1. To this end the web 1 passes around a large-diameter backing roller 4 centered on a horizontal axis 4A and normally driven by a motor indicated schematically at 36. The ends of this roller 4 are journaled in vertical end plates 6 of a frame 5. The frame 5 further has an upper transverse beam 7 interconnecting the end plates 6 and defining a horizontal opening that extends all the way to a floor F. The end plates 6 horizontally flank the web 1 and roller 4.

Underneath the backing roller 4 is a second frame 8 comprised of two end plates 9 and transverse connecting beams 10. This frame 8 is wholly received between the plates 6 of the frame 5 and can be moved horizontally out from underneath the roll 4, either toward the left as seen in FIG. 1 underneath the beam 7 or perpendicular to the plane of the view in FIG. 1 through an unillustrated hole in one of the end plates 6. The applicator unit 2 is carried wholly on this frame 8. Normally the frame 8 rides via rollers 37 on the floor F although other support systems such as an air cushion can be provided. A flap 38 pivoted on the beam 7 prevents spray from getting outside the machine but can be swung up to allow removal of the frame 8.

The dosing unit 3 is provided downstream of the applicator unit 2 on a third frame 11 so that this doing unit 3 can also be switched out without disturbing the application unit 2. Alternately the unit 3 can be mounted on the frame 8 or the frame 5.

The dosing unit 2 has as is well known a blade 12 whose foot edge is clamped in a beam 13 that is shiftable toward and away from the backing roller 4 in a scraper beam 14. A piston/cylinder unit 15 can pivot the scraper beam about an axis lying at the outer edge of the blade 12 between two end plates 16 of the frame 11 so that the angle of the blade relative to a tangent to the roller 4 can be adjusted. For fine adjustment of the blade angle the beam 14 is also pivotally supported by means of a spindle drive 17 in the end plates 16.

Although a blade 12 is shown for the dosing unit 3, it could have, instead, a rod, bar, or other device for removing the excess of treatment liquid from the surface of the web 1.

The applicator unit 2 has a rotatably driven applicator roller 18 with a smooth cylindrical surface which extends the full length of the web 1 and roller 4. The roller 18 is vertically displaceable in the frame 8 and defines a gap 19 with the web 1 wrapped around the roller 4. On its lower side turned away from the roller 4 it sits in a liquid tray or chamber 20 that is continuously supplied with the coating liquid. A curved guide plate 21 on the upstream side of the gap 19 serves to conduct the liquid from the trough 20 to the gap 9, with some excess flowing back over the upstream face of this plate 20 as shown at 22 and collecting in a trough 23 underneath the roller 18. The liquid scraped off by the blade 12 is also supplied to this trough or sump 23 whence it is pumped back into the chamber 20.

Figure 2:
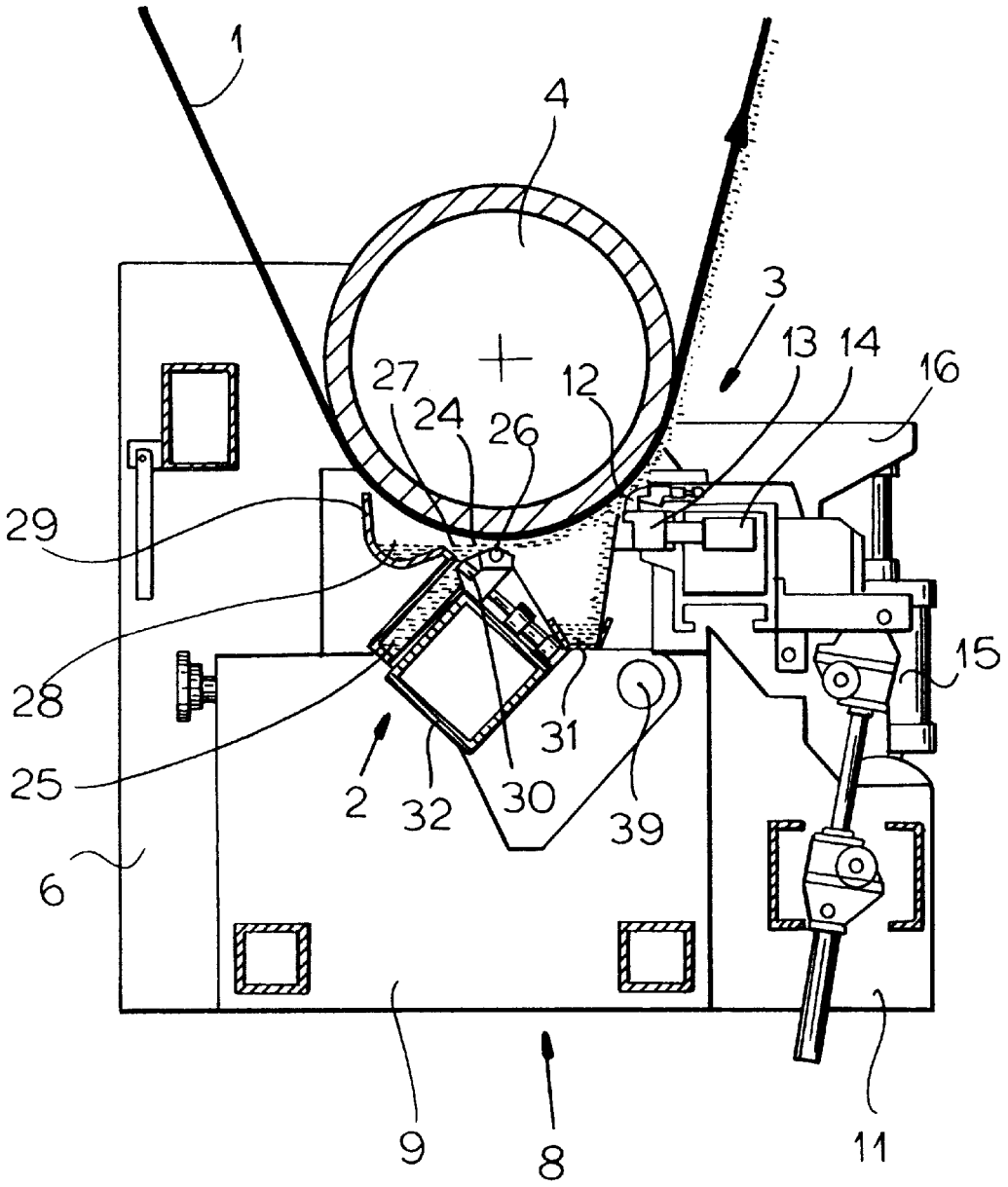
FIGS. 2 through 5 are views like FIG. 1 showing further system according to the invention.

In FIG. 2 the applicator unit 2 has an applicator trough or tray 24 which is supplied with treatment liquid from a reservoir or chamber 25. At its downstream end this chamber 24 is defined by a rotatable rod 26 which defines the gap 19 with the web 1 passing around the roller 4 so as to form on the web 1 an overly thick liquid coating. At its upstream side there is an overflow gap 27 so that excess liquid can move out at 28 and be caught in another trough 29. Such a system ensures that no dry spots are left on the web 1. An adjustable bar 30 is provided to control the rate of liquid application by controlling the flow-cross section at the input side of the chamber 24. Another trough 31 mounted on the frame 8 captures overflow liquid from the dosing unit 3. All these parts are carried on a transverse beam 32 which is pivotal about an axis 39 parallel to the axis 4A between the side plates 9 of the frame 8. Pivoting of the beam 32 allows the applicator unit 2 to be swung down from the illustrated use position into a lower position in which the system 2 can be cleaned or a new web 1 can be fed through the apparatus.

Figure 3:
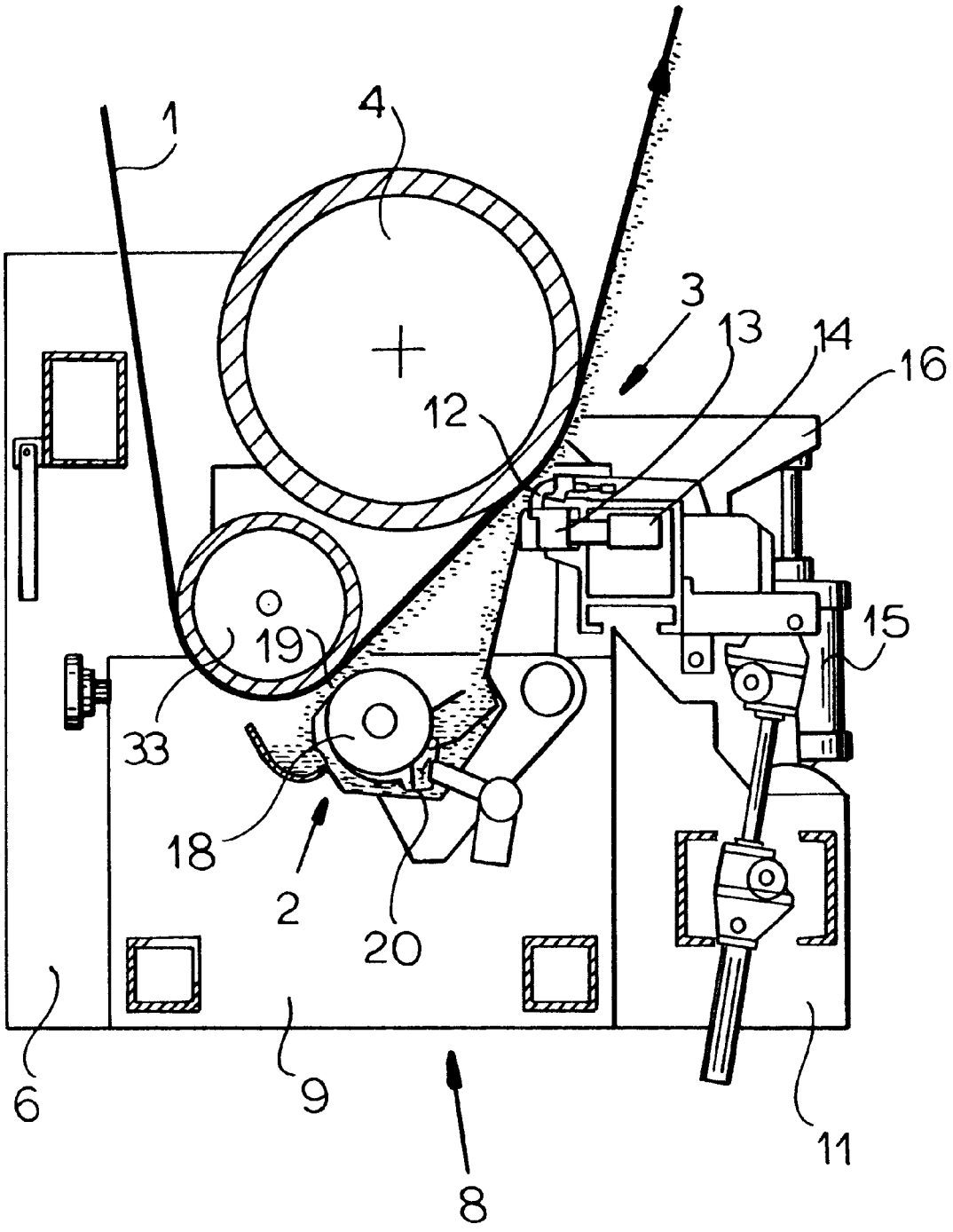

In FIG. 3 (and also in FIGS. 4 and 5) there is a second driven backing roller 33 that forms in the web 1 a straight stretch along which the coating liquid is applied and dosed. By making the web 1 run straight in this region there is no tendency for the liquid to be thrown off by centrifugal force so the web 1 can travel at very high speeds, in excess of 1000 m/min. The unit 2 forms the gap 19 at the roller 33 and the unit 3 at the roller 4.

Figure 4:
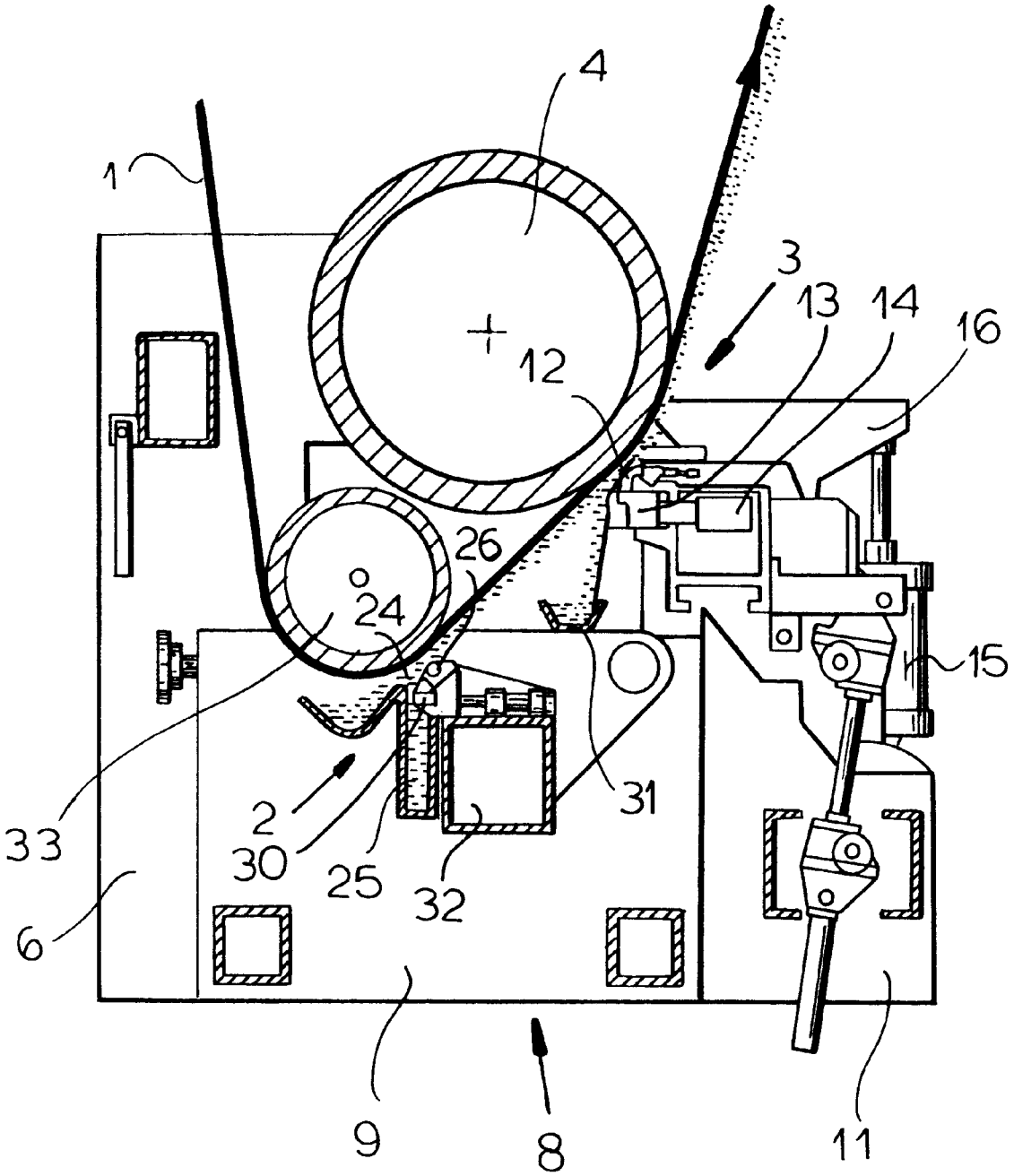

In FIG. 4 the applicator unit has its trough 24 juxtaposed with the second backing roller 33. Coating ink is supplied under pressure to the chamber 24 so as to be pumped against the web 1 at the roller 33.

Figure 5:
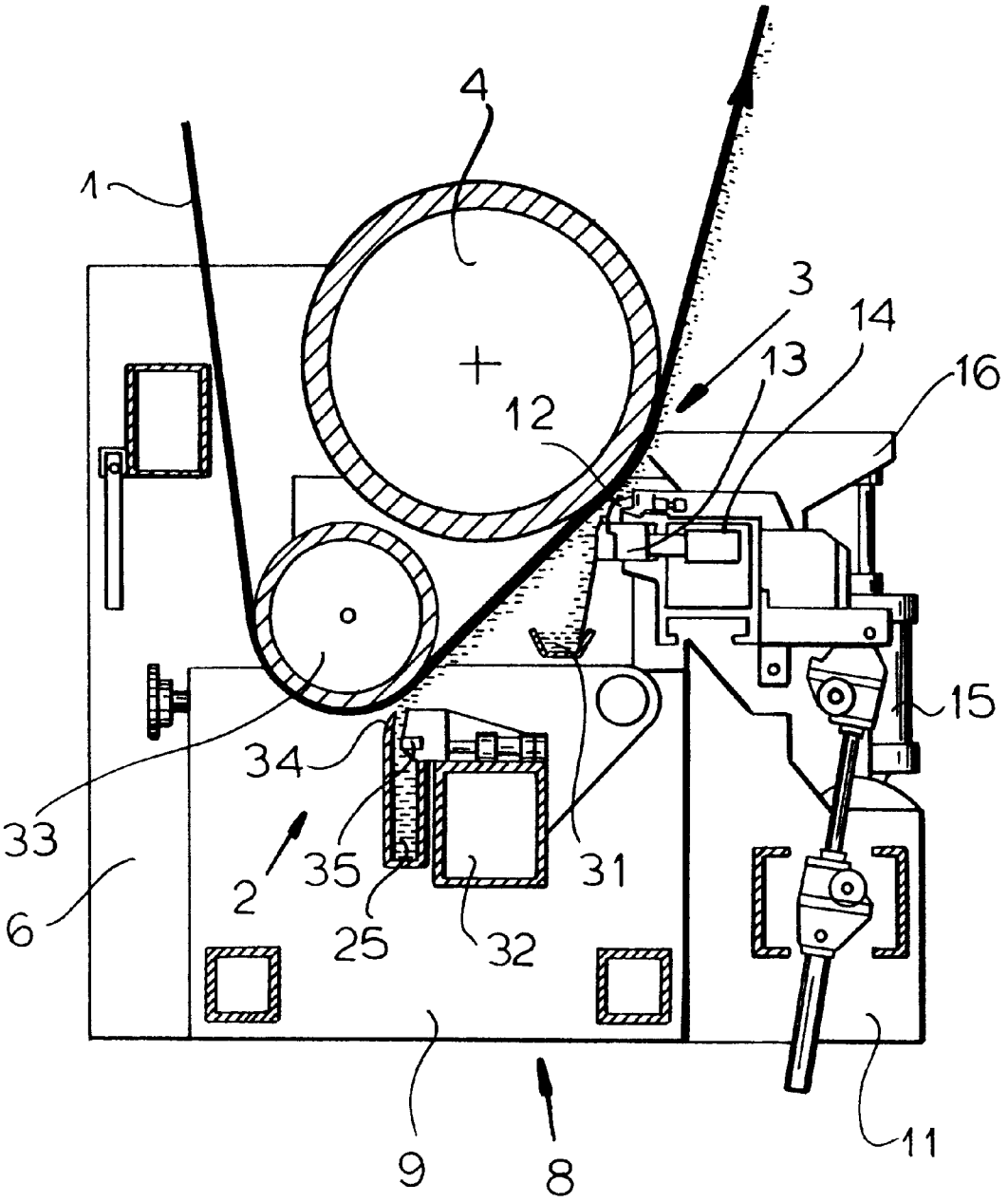

The system of FIG. 5 has a slot nozzle 34 that sprays the coating liquid onto the web 1. The slot nozzle 34 is supplied liquid from the supply chamber 25 whose outlet cross section is set by a movable bar 35. Thus the exact amount of excess liquid is applied to the web 1 as determined by the capacity of the pump. In this embodiment the applicator unit 2 has its own backing roller 33 journaled in the frame 8. The nozzle is at the upstream end of the straight web section.

We claim:

1. An apparatus for applying a coating liquid to a web moving continuously along a path, the apparatus comprising:

a main frame forming an open space and an opening into the space;

a main backing roller journaled on the main frame, the web passing around the backing roller;

a second frame independent of the main frame and displaceable relative to the main frame and through the opening between a use position in the space juxtaposed with the backing roller to a position pulled out of the main frame, the opening being open transversely to a direction of movement of the web along the path;

applicator means including an applicator element mounted on the second frame and closely juxtaposed with the web in the use position, a supply of the coating liquid mounted on the second frame, and a pump mounted on the second frame circulating the liquid to the applicator element, the applicator means for applying when the second frame is in the use position an excess of the coating liquid to the web; and dosing means downstream along the path from the applicator element when the second frame is in the use position for stripping from the web excess coating liquid and leaving on the web a coating of the liquid of a predetermined thickness.

2. The coating apparatus defined in claim 1 wherein the opening opens against a direction of movement of the web along the path.

3. The coating apparatus defined in claim 1, further comprising a third frame independent of the main frame, carrying the dosing means, and displaceable relative to the main frame from a position juxtaposed with the backing roller.

4. The coating apparatus defined in claim 1 wherein the applicator element is an applicator roller.

5. The coating apparatus defined in claim 1 wherein the liquid supply includes a tray holding the liquid and juxtaposed with the backing roller.

6. The coating apparatus defined in claim 1 wherein the applicator element is a slot nozzle open toward the web.

7. The coating apparatus defined in claim 1 wherein the dosing means is mounted on the main frame.

8. The coating apparatus defined in claim 1 wherein the dosing means is mounted on the second frame.

9. An apparatus for applying a coating liquid to a web moving continuously along a path, the apparatus comprising:

a main frame forming an open space;

a main backing roller journaled on the main frame, the web passing around the backing roller;

a second frame in the space, independent of the main frame, and displaceable relative thereto from a position in the space juxtaposed with the backing roller;

applicator means on the second frame for applying an excess of the coating liquid to the web;

dosing means downstream along the path from the applicator means for stripping from the web excess coating liquid and leaving on the web a coating of the liquid of a predetermined thickness; and a second backing roller journaled on the second frame and juxtaposed with the applicator means.

10. An apparatus for applying a coating liquid to a web moving continuously along a path in a direction, the apparatus comprising:

a main frame forming an open space and forming an opening directed transversely to the direction and into the space;

a main backing roller journaled on the main frame, the web passing around the backing roller;

a second frame in the space, independent of the main frame, movable horizontally out of the space through the opening, and displaceable relative thereto from a position in the space juxtaposed with the backing roller;

applicator means on the second frame for applying an excess of the coating liquid to the web; and dosing means downstream along the path from the applicator means for stripping from the web excess coating liquid and leaving on the web a coating of the liquid of a predetermined thickness.

11. An apparatus for applying a coating liquid to a web moving continuously along a path in a direction, the apparatus comprising:

a main frame forming an open space;

a main backing roller journaled on the main frame, the web passing around the backing roller;

a second frame in the space, independent of the main frame, movable horizontally out of the space, and displaceable relative thereto from a position in the space juxtaposed with the backing roller;

applicator means on the second frame for applying an excess of the coating liquid to the web; and dosing means mounted on the main frame downstream along the path from the applicator means for stripping from the web excess coating liquid and leaving on the web a coating of the liquid of a predetermined thickness.

12. An apparatus for applying a coating liquid to a web moving continuously along a path in a direction, the apparatus comprising:

a main frame forming an open space;

a main backing roller journaled on the main frame, the web passing around the backing roller;

a second frame in the space, independent of the main frame, movable horizontally out of the space, and displaceable relative thereto from a position in the space juxtaposed with the backing roller;

applicator means including a roller on the second frame for applying an excess of the coating liquid to the web; and dosing means downstream along the path from the applicator means for stripping from the web excess coating liquid and leaving on the web a coating of the liquid of a predetermined thickness.

13. An apparatus for applying a coating liquid to a web moving continuously along a path, the apparatus comprising:

a main frame forming an open space;

a main backing roller journaled on the main frame, the web passing around the backing roller;

a second frame independent of the main frame and displaceable relative to the main frame between a use position in the space juxtaposed with the backing roller to a position pulled out of the main frame;

applicator means including an applicator roller mounted on the second frame and closely juxtaposed with the web in the use position, a supply of the coating liquid mounted on the second frame, and a pump mounted on the second frame circulating the liquid to the applicator roller, the applicator means for applying when the second frame is in the use position an excess of the coating liquid to the web; and dosing means downstream along the path from the applicator roller when the second frame is in the use position for stripping from the web excess coating liquid and leaving on the web a coating of the liquid of a predetermined thickness.

14. An apparatus for applying a coating liquid to a web moving continuously along a path, the apparatus comprising:

a main frame forming an open space;

a main backing roller journaled on the main frame, the web passing around the backing roller;

a second frame independent of the main frame and displaceable relative to the main frame between a use position in the space juxtaposed with the backing roller to a position pulled out of the main frame;

applicator means including an applicator element mounted on the second frame and closely juxtaposed with the web in the use position, a supply of the coating liquid mounted on the second frame, and a pump mounted on the second frame circulating the liquid to the applicator element, the applicator means for applying when the second frame is in the use position an excess of the coating liquid to the web; and dosing means mounted on the main frame downstream along the path from the applicator element when the second frame is in the use position for stripping from the web excess coating liquid and leaving on the web a coating of the liquid of a predetermined thickness.

* * * * *